US007111527B1

(12) United States Patent
Lee

(10) Patent No.: US 7,111,527 B1
(45) Date of Patent: Sep. 26, 2006

(54) SELECTIVE ONE-WAY SCREWDRIVER

(76) Inventor: Yi Min Lee, No. 62, Renmei Rd., Dali City, Taichung County (TW) 412

( * ) Notice: Subject to any disclaimer, the term of this patent is extended or adjusted under 35 U.S.C. 154(b) by 0 days.

(21) Appl. No.: 11/225,448

(22) Filed: Sep. 13, 2005

(51) Int. Cl.
*B25B 13/46* (2006.01)
*B25B 13/52* (2006.01)
*B25B 13/00* (2006.01)

(52) U.S. Cl. ..... 81/63.1; 81/60; 81/58.1

(58) Field of Classification Search ..... 81/63.1, 81/60, 58.1, 124.3, 124.7, 125
See application file for complete search history.

(56) References Cited

U.S. PATENT DOCUMENTS 4,602,534 A * 7/1986 Moetteli ..... 81/177.85
4,986,147 A * 1/1991 Cooper ..... 81/63.2
5,957,009 A * 9/1999 McCann ..... 81/63.2
6,164,167 A * 12/2000 Chen ..... 81/63.2
6,691,594 B1 * 2/2004 Chen ..... 81/61
6,708,586 B1 * 3/2004 Chen ..... 81/63.2
6,857,339 B1 * 2/2005 Chen ..... 81/63.1
6,860,175 B1 * 3/2005 Hu ..... 81/58.1
6,971,286 B1 * 12/2005 Hu ..... 81/63.2
2003/0121371 A1 * 7/2003 Chiu ..... 81/63.1
2003/0154826 A1 * 8/2003 Lee ..... 81/63.1
2004/0093995 A1 * 5/2004 Hu ..... 81/63.2

* cited by examiner

*Primary Examiner*—Lee. D. Wilson
*Assistant Examiner*—Alvin J Grant
(74) *Attorney, Agent, or Firm*—Charles E. Baxley

(57) ABSTRACT

There is disclosed a selective one-way screwdriver and, more particularly, a selective one-way screwdriver that includes a long handle and can easily be operated. It includes an elongated handle formed with at least one head formed at an end. The head defines a space for receiving an annular gear formed with a toothed wheel portion on the external side. The annular gear includes a recess in an end in order to receive a bit. The head further defines a cavity near the handle and a channel between the cavity and the space. A switch is put in the cavity. In the channel are put two pawls one of which can selectively be engaged with the toothed wheel portion of the annular gear under the control of the switch. Thus, the handle can drive the annular gear in selective one of two directions. The length of the handle is perpendicular to the axis of the bit so that a user can easily use a small force in order to a large torque through the selective one-way screwdriver.

6 Claims, 5 Drawing Sheets

SELECTIVE ONE-WAY SCREWDRIVER

BACKGROUND OF INVENTION

1. Field of Invention

The present invention relates to a selective one-way screwdriver and, more particularly, to a selective one-way screwdriver with a torque arm perpendicular to the axis of a screwdriver bit so that a user can use a small force to generate a large torque.

2. Related Prior Art

A ratchet mechanism is used because it provides selective one-way driving so that a user will not drive while returning a tool to its original position, thus saving troubles in reengaging. Hence, ratchet mechanisms are used in various hand tools such as screwdrivers. Examples of such screwdrivers can be found in Taiwanese Patent Publication Nos. 500021, 507641, 527993 and 578653.

The ratchet mechanisms are used in the screwdrivers in order to provide selective one-way driving. However, as the bit and the handle extend in one axis, the torque arm is the radius of the handle. Hence, its operation is inconvenient and requires a large force. Limited by space, the replaceable bit can only be inserted in an extension rod of the handle. Without any device for retaining the bit, the bit often falls in operation, and this is inconvenient.

As discussed above, conventional ratchet screwdrivers do not provide adequate torque arms. Hence, their operation is inconvenient and requires a large force. In other words, there has not been any ratchet screwdriver that provides an adequate torque arm.

The present invention is therefore intended to obviate or at least alleviate the problems encountered in prior art.

SUMMARY OF INVENTION

The primary objective of the present invention is to provide a selective one-way screwdriver through which a user can use a small force to generate a large torque.

According to the present invention, a selective one-way screwdriver includes a handle, at least one head at an end of the handle and a selective one-way driving device at the head. The head defines a space, a cavity in the top and a channel between the space and the cavity. The selective one-way driving device includes a switch put in the cavity, a pawl device movable in the channel under the control of the switch and an annular gear put in the space. The annular gear includes a toothed wheel portion on the external side for engagement with the pawl device and a recess in an end for receiving a bit. Hence, the selective one-way screwdriver can easily be used to generate a large torque.

Other advantages and novel features of the invention will become more apparent from the following detailed description in conjunction with the drawings.

BRIEF DESCRIPTION OF DRAWINGS

The present invention will be described through detailed illustration of the preferred embodiment thereof referring to the drawings.

DETAILED DESCRIPTION OF PREFERRED EMBODIMENT

Figure 1:
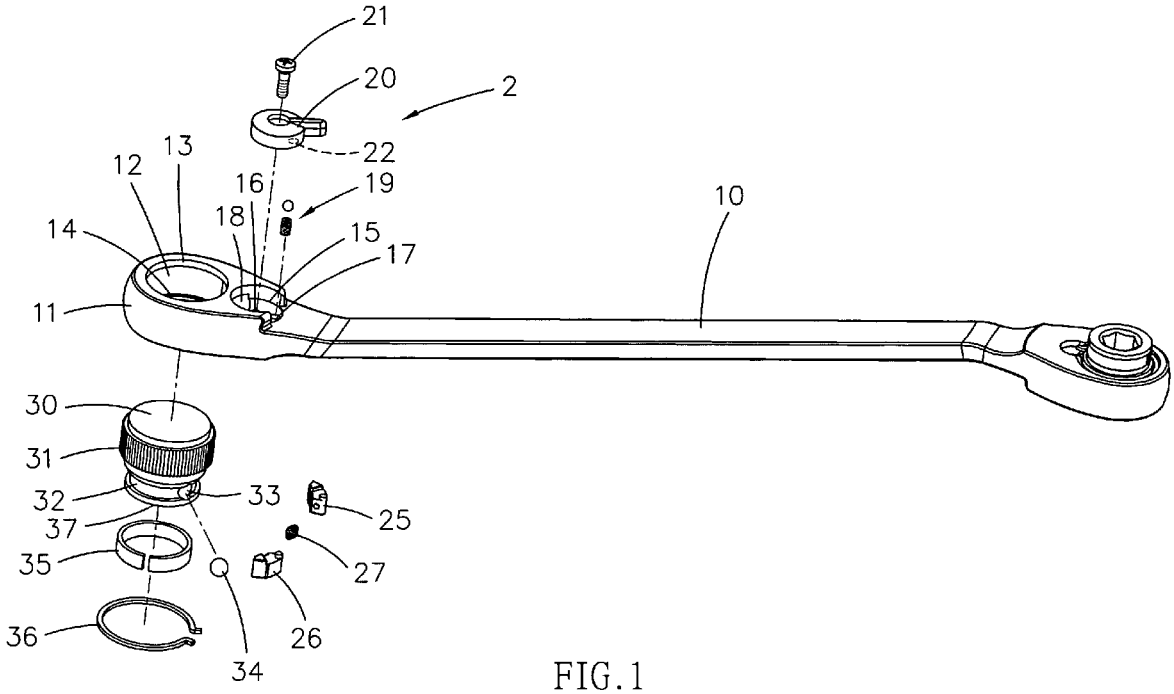
FIG. 1 is an exploded view of a selective one-way screwdriver according to the preferred embodiment of the present invention.
Figure 2:
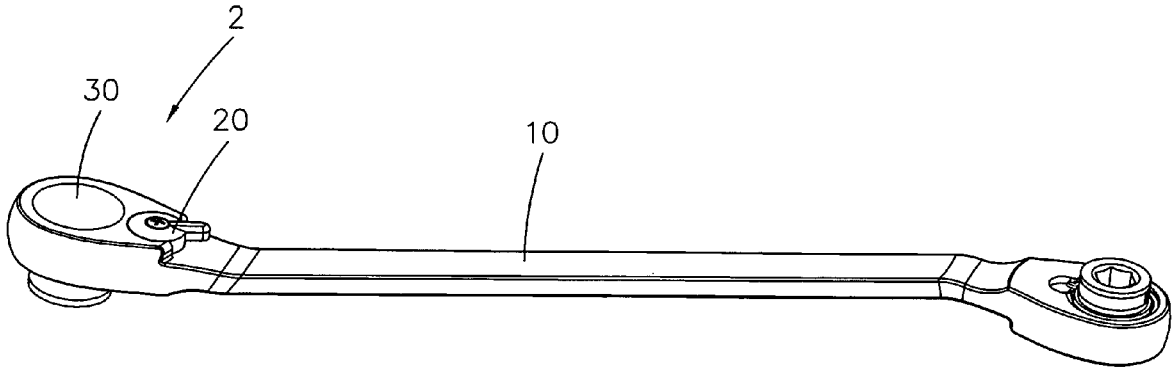
FIG. 2 is a perspective view of the selective one-way screwdriver shown in FIG. 1.
Figure 3:
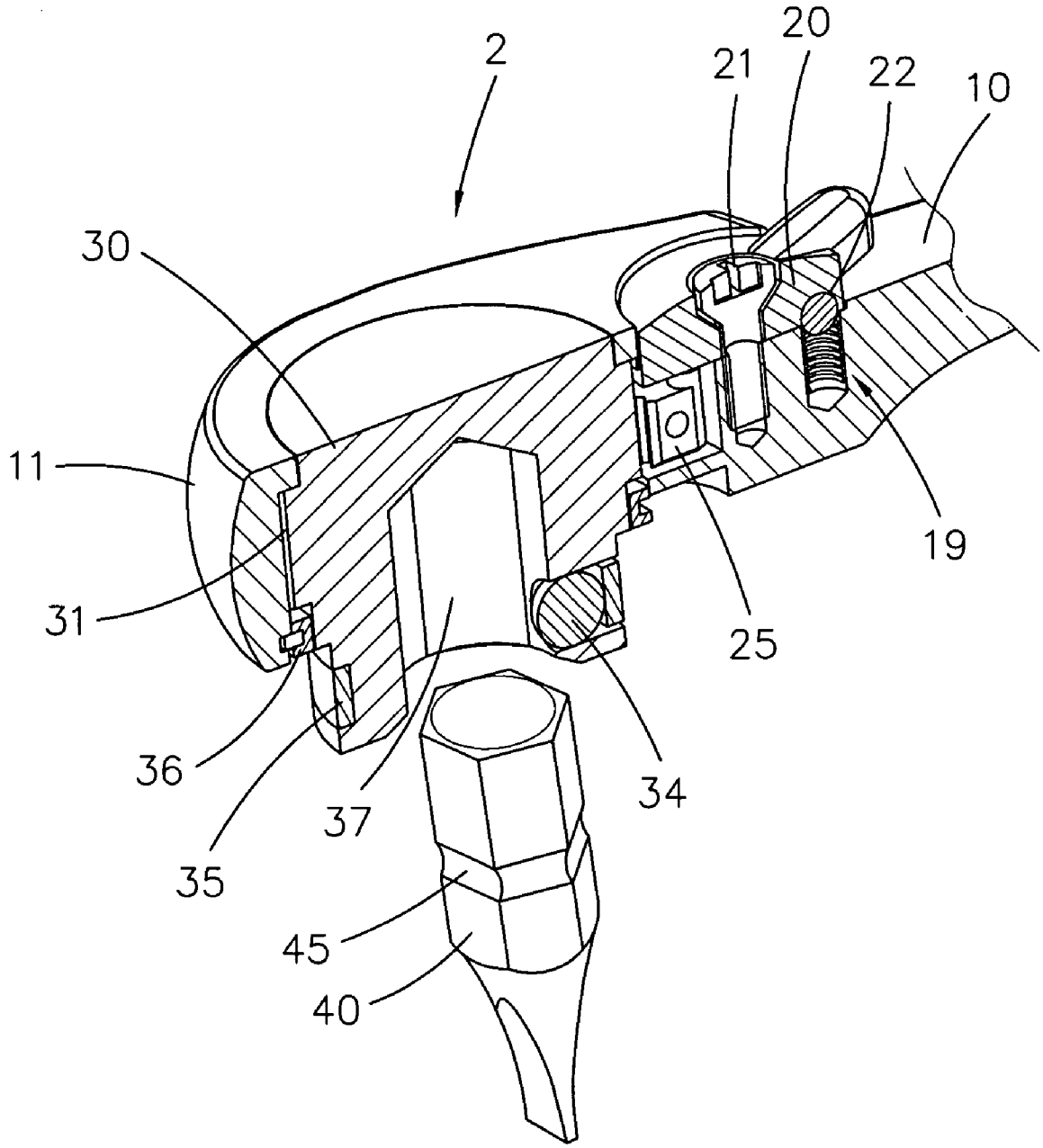
FIG. 3 is a cutaway view of the selective one-way screwdriver shown in FIG. 2.

Referring to FIGS. 1 and 2, there is shown a selective one-way screwdriver according to the preferred embodiment of the present invention. The selective one-way screwdriver includes a handle 10, at least one head 11 formed at an end of the handle 10 and a selective one-way driving device 2 installed on the head 11. The selective one-way driving device 2 includes a switch 20, two pawls 25 and 26, and an annular gear 30. The annular gear 30 is used for driving a bit 40 as shown in FIG. 3. The axis of the annular gear 30 is perpendicular to the length of the handle 10.

Referring to FIGS. 1 through 3, more details of the selective one-way screwdriver will be given. The head 11 defines a space 12 from the top to the bottom. The space 12 is circular in a top view of the selective one-way screwdriver. On the wall of the space 12 is formed a lip 13 for retaining the annular gear 30 from the top. Because of the lip 13, the annular gear 30 can only be put into the space 12 upwardly. In the wall of the space 12 is defined a groove 14 for receiving a C-clip 36 for retaining the annular gear 30 from the bottom. The head 11 defines a cavity 15. A screw hole 16 is defined in the center of the floor of the cavity 15. In the floor of the cavity 15 is defined a recess 17 for containing a spring-biased detent 19 for positioning the switch 20. The head 11 defines a channel 18 between the space 12 and the cavity 15. The channel 18 is crescent a top view of the selective one-way screwdriver. The pawls 25 and 26 are put in the channel 18.

The switch 20 of the selective one-way driving device 2 is installed pivotally in the cavity 15 by means of a screw 21 driven into the screw hole 16. On the bottom of the switch 20 are defined three recesses 22 deployed along an arc for receiving the spring-biased detent 19 for positioning the switch 20. A spring 27 is compressed between the pawls 25 and 26. The pawls 25 and 26 are moved by means of the switch 20.

The annular gear 30 includes a toothed wheel portion 31 with an enlarged diameter. The toothed wheel portion 31 is kept between the lip 13 and the C-clip 36. The toothed wheel portion 31 can be engaged with the pawl 25 or 26 selectively. The annular gear 30 includes, in the center of the bottom, a hexangular recess 37 or receiving the hexangular profile of the bit 40. A groove 32 is defined in a lower portion of the annular gear 30. The groove 32 is communicated with the hexangular recess 37 through an aperture 33. In the aperture 33 is put a detent 34 in the form of a ball. A first end of the detent 34 is put in the hexangular recess 37 while a second end is put in the groove 32. An elastic ring 35 is put in the groove 32 against the second end of the detent 34. Thus, the first end of the detent 34 is forced into the hexangular recess 37. In a middle portion of the bit 40 is defined a groove 45 for receiving the detent 34, thus keeping the bit 40 in the hexangular recess 37.

Hence, there is provided a selective one-way screwdriver through which a user can easily use a small force to generate a large torque.

Figure 4:
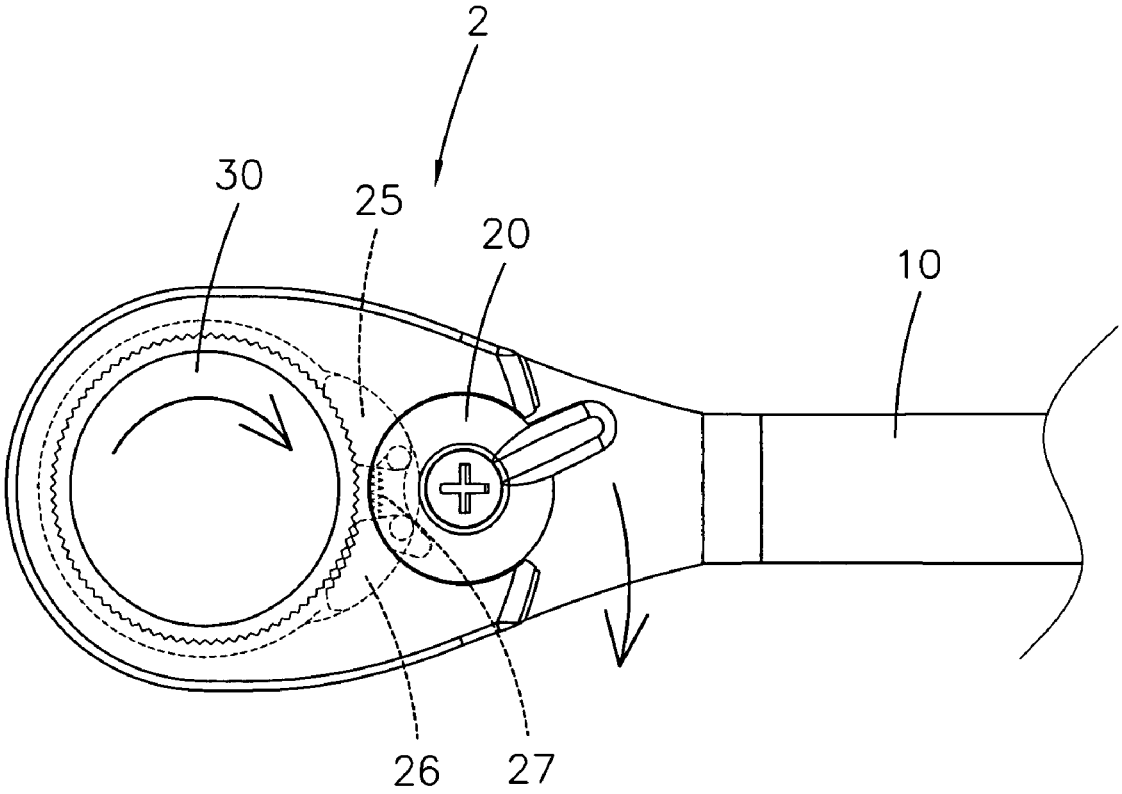
FIG. 4 is a top view of the selective one-way screwdriver shown in FIG. 2 in a clockwise mode.
Figure 5:
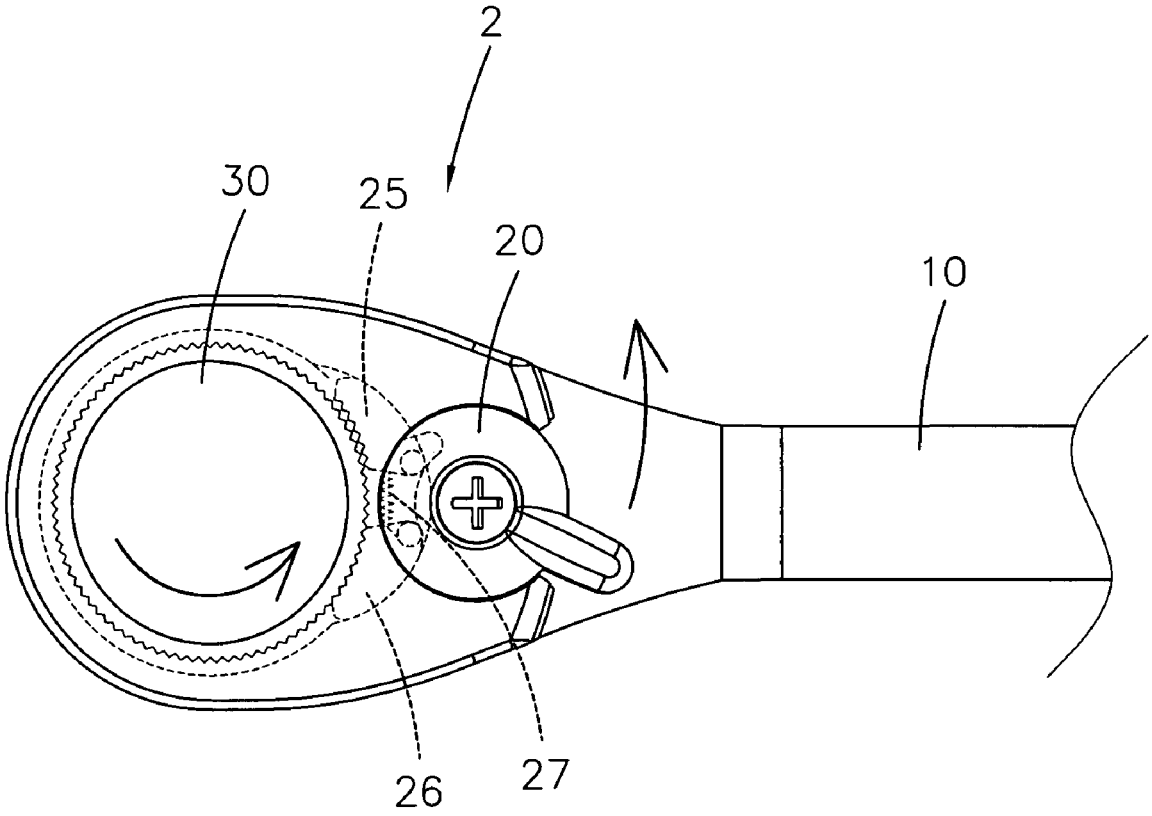
FIG. 5 is a top view of the selective one-way screwdriver shown in FIG. 2 in a counterclockwise mode.

The operation of the selective one-way screwdriver will be described referring to FIGS. 3 through 5. In use, the bit 40 is inserted in the hexangular recess 37 of the annular gear 30, and the detent 34 is put in the groove 40 of the bit 40.

By operating the switch 20, the pawl 25 or 26 is selectively engaged with the toothed wheel portion 31 of the annular gear 30. Thus, selective one-way driving is achieved.

In the selective one-way screwdriver of the present invention, a long distance is provided between the axis of the bit 40 and a portion of the handle 10 gripped by a user, so that the user can use a small force to generate a large torque. Moreover, restrained by means of the detent 34, the bit 40 will not fall from the annular gear 30 in operation. Hence, the convenience of operation is increased.

The present invention has been described through the detailed illustration of the preferred embodiment. Those skilled in the art can derive variations from the preferred embodiment without departing from the scope of the present invention. Hence, the preferred embodiment shall not limit the scope of the present invention defined in the claims.

What is claimed is:

1. A selective one-way screwdriver comprising:

a handle (10);

at least one head (11) at an end of the handle (10), the head (11) defining a space (12), a cavity (15) in the top, a recess (17) eccentrically in the floor of the cavity (15), and a channel (18) between the space (12); and a selective one-way driving device (2) comprising:

a spring-biased detent (19) disposed in the recess (17) of the head (11);

a switch (20) disposed in the cavity (15), the switch (20) comprising three recesses (22) selective one of which receives the spring-biased detent (19) in order to position the switch (20);

a pawl device (25; 26; 27) movable in the channel (18) under the control of the switch (20); and an annular gear (30) disposed in the space (12), the annular gear (30) comprising a toothed wheel portion (31) on the external side for engagement with the pawl device (25; 26; 27) and a recess (37) in an end for receiving a bit (40) so that a large torque can easily be generated.

2. The selective one-way screwdriver according to claim 1 wherein the head (11) comprises a lip (13) on the wall of the space (12) and a groove (14) in the wall of the space (12), wherein the selective one-way screwdriver comprises a C-clip (36) disposed in the groove (14) in order to retain the annular gear (30).

3. The selective one-way screwdriver according to claim 1 or 2 wherein the toothed wheel portion (31) is made with an enlarged diameter so that it is retained between the lip (13) and the C-clip (36).

4. The selective one-way screwdriver according to claim 1 wherein the head (11) comprises a screw hole (16) in the center of the floor of the cavity (15), wherein the selective one-way screwdriver comprises a screw (21) driven into the screw hole (16) in order to retain the switch (20) in the cavity (15).

5. The selective one-way screwdriver according to claim 1 wherein the pawl device (25; 26; 27) comprises two pawls (25; 26) and a spring (27) compressed between the pawls (25; 26).

6. The selective one-way screwdriver according to claim 1 wherein the annular gear (30) comprises a groove (32) in the external side and an aperture (33) between the groove (32) and the recess (37) thereof, wherein the selective one-way screwdriver comprises:

a detent (34) disposed substantially in the aperture (33) with a first end in the recess (37) thereof and a second end in the groove (32); and an elastic ring (35) disposed in the groove (32) against the second end of the detent (34) in order to force the first end of the detent (34) into a groove (45) in the periphery of the bit (40).

* * * * *